United States Patent [19]

Gaetano

[11] 4,274,625

[45] Jun. 23, 1981

[54] EXERCISING APPARATUS

[76] Inventor: Salvatore Gaetano, 130-16 115th St., South Ozone Park, Queens, N.Y. 11420

[21] Appl. No.: 972,669

[22] Filed: Dec. 26, 1978

[51] Int. Cl.[3] ..... A63B 23/06

[52] U.S. Cl. ..... 272/69; 184/12; 184/101; 193/35 R; 308/20; 403/342

[58] Field of Search ..... 272/69, 70, 70.3, 70.4; 128/25 R, 25 B; 193/35 R, 35 J, 35 A, 35 SS, 35 C, 35 TE, 35 F, 35 MD, 35 G, 35 B, 35 S, 36, 37; 308/20; 184/12, 101; 403/341, 342

[56] References Cited

U.S. PATENT DOCUMENTS

| | | | |
|---|---|---|---|
| 797,638 | 8/1905 | Thomas | 403/342 X |
| 1,064,968 | 6/1913 | Hagen | 272/69 |
| 1,406,228 | 2/1922 | Riedel | 193/35 R |
| 2,165,700 | 7/1939 | Glynn | 272/70.4 X |
| 2,614,609 | 10/1952 | Denison | 272/70 |
| 3,193,287 | 7/1965 | Robinson | 272/69 |
| 3,703,284 | 11/1972 | Hesen | 272/69 |
| 3,897,055 | 7/1975 | Caldow | 272/1 R X |

FOREIGN PATENT DOCUMENTS

| | | | |
|---|---|---|---|
| 1044355 | 11/1958 | Fed. Rep. of Germany | 272/69 |
| 1432392 | 2/1966 | France | 272/69 |
| 1495436 | 12/1977 | United Kingdom | 272/70 |

*Primary Examiner*—Richard C. Pinkham
*Assistant Examiner*—Arnold W. Kramer
*Attorney, Agent, or Firm*—Samson Helfgott

[57] ABSTRACT

An exercising apparatus having a base member with a roller assembly positioned on the surface of the base member. The roller assembly is formed of an array of discrete rollers having a series of parallel axles with closely spaced rollers mounted on the axles for individual rotation and supported by support bars. A frame upwardly extends from the base member and defines an enclosed exercising area. The frame includes both front and rear handle bars. The base member can be adjustably positioned at a variable incline with respect to the support surface on which it rests. The exercising apparatus can be used for walking, jogging, as well as exercising of the arms and shoulders and permits both uphill and downhill exercising.

16 Claims, 11 Drawing Figures

FIG. 1
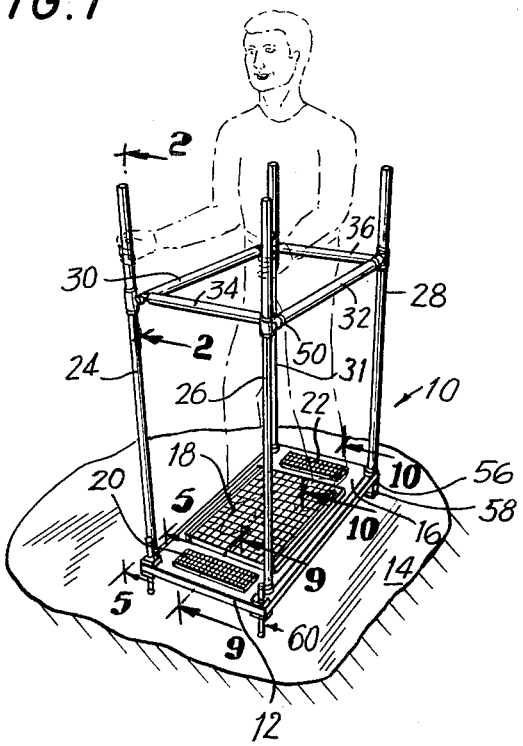
FIG. 2
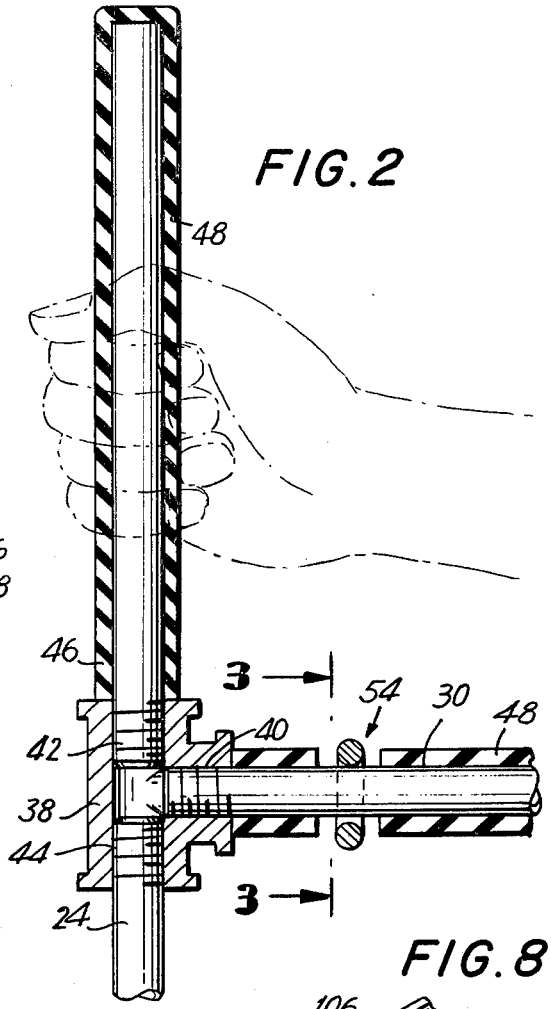
FIG. 3
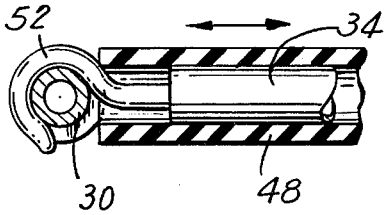
FIG. 8
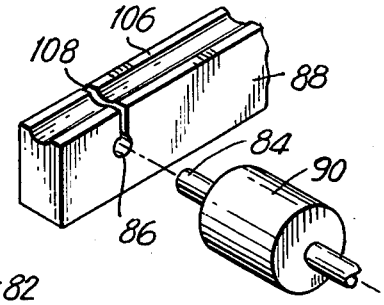
FIG. 4
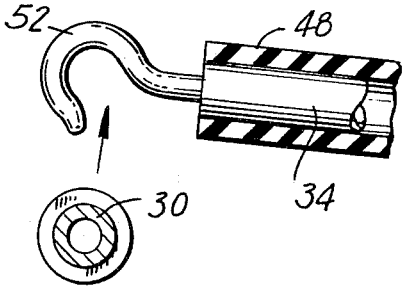
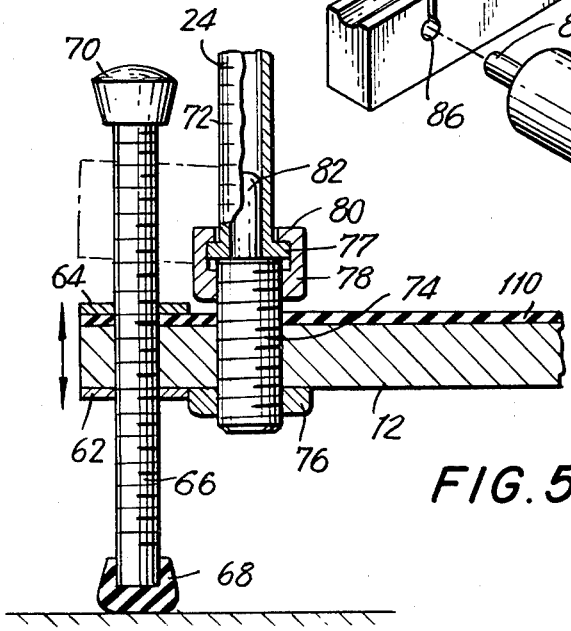
FIG. 5

EXERCISING APPARATUS

BACKGROUND OF THE INVENTION

Exercising has long been recognized as an important factor in maintaining the well being of an individual. The popularity of aerobic exercises, especially jogging, has been steadily increasing. By jogging, or even walking at a fast pace, the greatest energy expenditure can be achieved in the least amount of time. Such exercises have been recommended for physical fitness as well as for cardiovascular purposes.

While many people jog outdoors, it has long been felt that suitable devices are needed to permit indoor jogging thereby permitting continuity of exercising even in inclement weather. Additionally, in many areas there is very limited availability of proper exercising areas outdoors.

Furthermore, many people only have time for exercising during the evening hours and then hesitate going outdoors because of the darkness. In many situations, outdoor jogging requires running on an uneven surface which causes leg, knee and foot injuries. Even with proper footgear many individuals do not know how to jog properly without injuring themselves on the hard or uneven surface and thus are forced to discontinue their activities.

In order to alleviate these problems there has been introduced numerous indoor jogging devices. Most of these devices include a treadmill or endless belt type of surface placed on a base member with a handle bar upwardly extending from the elevated base member. In some cases the mechanism is motorized whereby the treadmill is power driven and the speed of the rotation of the belt can be adjusted. However, these devices are not portable for home use. Also, they are extremely expensive, heavy, and are prone to frequent breakdowns because of the heavy force which they must endure.

Other jogging apparatus are non-motorized. In these types, the endless belt is connected to move on large rollers which are usually large wooden rollers. This type is called a treadmill jogger. This type of apparatus has an elevated base with handle bars extending from the elevated base. It is used by facing the elevated base and holding onto the handle bars. During usage, the feet move in a backward direction. Typically, this type of apparatus has at least two fixed settings for incline adjustment at the elevated base end. It also includes two tension adjustments at each corner of the front base end. However, the adjustments are quite unreliable and are troublesome. Resistance to jogging is either lacking or too great with a result that the exercise is neither beneficial nor comfortable. Since the rollers are usually made of hard wood and are large with a wide spacing, it produces much discomfort to the soles of the feet and provides an excessive amount of vibration and noise.

With all prior art treadmill devices, it is necessary to fully jog on the treadmill in order to utilize the device. However, many individuals who would like to exercise are not capable or are not permitted to jog at a fast pace. For example, elderly individuals may want to utilize the device but cannot jog. For such individuals a fast walking pace would be sufficient to provide them with the needed exercise. Furthermore, all individuals when first entering onto the exercise device and commencing their exercise routine should begin with a slow exercise and build up to a fast pace. Similarly, before stopping the exercise there should also be a gradual slowing down of the pace. This unwinding period frequently includes walking or jogging at a slower pace. However, with prior devices, walking on the device was in many instances too straining for a steady, uniform stride.

Specifically, with the use of a treadmill, there is provided a single moving surface on the base member. Especially in the non-motorized type, the movement of the foot pushes onto the treadmill and makes it rotate. However, as one foot is pushing back to move the treadmill, the other foot must be removed from the treadmill or it will move back on the treadmill and the individual may slip or fall. Accordingly, in using prior art jogging devices, it was necessary to have only one foot on the treadmill surface at a time. To achieve this it was necessary to jog. In walking, frequently both feet will be on the surface for at least a portion of the time. Accordingly, walking exercising was not always achievable with prior art jogging devices.

A further problem with prior art jogging devices concerns the degree of restraint. Since the handle bars are at the elevated end of the device, it can be used only at that end. Also, since the adjustments for incline and tension are both limited and troublesome to alter, the individual can rarely arrive at a suitable adjustment to suit him.

However, it has been found that in jogging or walking fast downhill, additional muscles are utilized in the leg and body and it would be beneficial to provide for both uphill and downhill jogging in order to have a complete workout. Such jogging was not achievable with the prior art devices since the device could only be raised at one end, and the handle bars were provided at that same end.

Other problems with prior art devices concern the maintanence and upkeep of the device. Because of the presence of the treadmill, there was always a tendancy of the endless belt to wear and tear along its sewed or joined seam. Also, there was great vibration in the device since it required the endless belt to move on large rollers usually wooden. The vibration tended to cause damage to the device itself and also provided a very uncomfortable feeling for the user. The belt surface would also wear, and the constant pounding force caused an erratic stop and go type of jogging motion which reduced the longevity of the useful life of the device.

Because of the foregoing and numerous other reasons, exercising experts have advised against utilizing such indoor treadmill devices and, as a result, sales of these devices have been at a virtual standstill.

SUMMARY OF THE INVENTION

Accordingly, it is an object of the present invention to provide an exercising apparatus which avoids the aforementioned problems of prior art devices.

Yet a further object of the present invention is to provide an exercising apparatus which permits jogging and walking.

Still another object of the present invention is to provide an exercising apparatus which permits various degrees of resistance in uphill and downhill exercising.

Yet a further object of the present invention is to provide an exercising device which permits exercising of the upper part of the body, such as the arms, chest and shoulders, while carrying out usual jogging exercises.

A further object of the present invention is to provide an exercising device which permits walking, jogging, movement uphill and movement downhill and permits the user to adjust his speed of movement as he desires during the course of his exercising routine.

A further object of the present invention is to provide an exercising device which permits walking and jogging and permits adjustment of the incline of the device relative to a support surface.

Yet a further object of the present invention is to provide an exercising device having a base frame with a pivotable roller assembly permitting lifting of the roller assembly for easy cleaning.

A further object of the present invention is to provide an exercising device for jogging and walking which can be easily assembled and disassembled by hand within a few minutes without any tools and which can be carried, and easily stored.

Still another object of the present invention is to provide an exercising device for jogging and walking which permits easy lubrication of the roller assembly to maintain the device in good operating condition without getting oil on the rolling surface itself.

Still a further object of the present invention is to provide an exercising device for walking and jogging which does not utilize a treadmill or endless belt and thereby reduces the vibration of the device.

Another object of the present invention is to provide an exercising device which can be easily manufactured, is sturdy, durable, easy to utilize and permits various types of exercising.

A further object of the present invention is to provide an exercising device for walking and jogging which provides for a shock absorbing jogging surface to reduce the risk of pain in the legs, knees and feet of the jogger.

Briefly, in accordance with the present invention there is provided an exercising apparatus, comprising a base member with a roller assembly positioned on the base member. The roller assembly includes an array of discrete rollers. A frame upwardly extends from the base member and defines an enclosed exercising area.

In an embodiment of the invention, the roller assembly is formed of a series of parallel axels with a plurality of closely spaced rollers mounted on the axles for individual rotation thereon. Support means holds the parallel axles in proper relationship.

The support means include a series of elongated support bars spacedly positioned from each other and in perpendicular relationship with the axles. Aligned bores formed in the support bars rotatingly receive the axles. The rollers are located on sections of the axles between the support bars.

To facilitate lubricating the roller assembly, channels are formed along the top of each support bar with vertical slots downwardly extending from the channels to each bore in the bar. Lubricating oil can be placed in the channels to flow down the slots to reach the axles and lubricate the roller assembly.

The upwardly extending frame can be removed from the base member and disassembled to provide easy storage. The base member can be inclined with respect to the support surface on which it rests. The frame effectively provides both front and rear handle bars. As a result, both uphill and downhill exercising can be achieved. Furthermore, by holding onto the frame the upper part of the body can also be exercised simultaneously with the jogging.

Because of the individually rotatable rollers on the roller assembly, each foot can control the rolling of the corresponding rollers thereunder, whereby both jogging and walking can be achieved on the device and easy adjustment of the pace can be achieved while remaining on the device.

The foregoing objects, features and advantages of the invention will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings:

FIG. 1 shows a perspective view of the exercising apparatus in accordance with the present invention;

FIG. 2 is a fragmentary sectional view taken along line 2—2 of FIG. 1 and showing a portion of the upper part of the frame;

FIG. 3 is a fragmentary sectional view taken along line 3—3 of FIG. 2 and showing the locking mechanism for the frame assembly;

FIG. 4 shows a fragmentary sectional view similar to that of FIG. 3 and showing the opening of the frame assembly;

FIG. 5 is a fragmentary sectional view showing the level adjustment device and the disassembling feature of the exercising apparatus;

FIG. 8 shows a fragmentary view of the roller assembly and specifically the lubricating feature;

In the various figures of the drawing, like reference characters designate like parts.

DESCRIPTION OF THE PREFERRED EMBODIMENT

Figure 6:
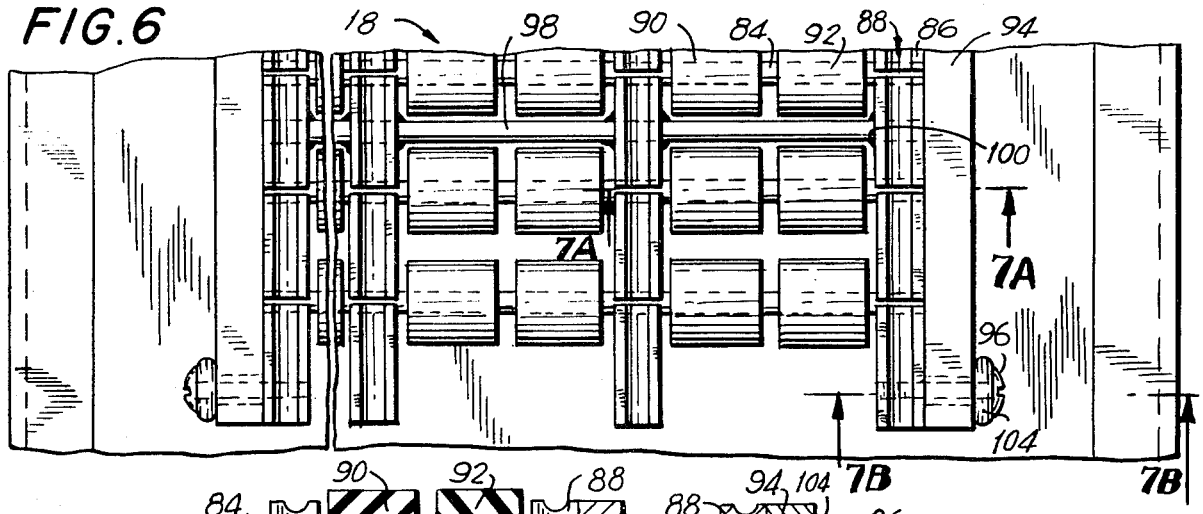
FIG. 6 shows a sectional view of the roller assembly in accordance with the present invention.

Referring now to the figures, and specifically FIG. 1, the exercising apparatus shown generally at 10 includes a base member 12 placed on a support surface such as the floor 14. Located on the top surface 16 of the base member is a roller assembly 18. The base member is shown as a substantially rectangular member and the roller assembly is also shown as a rectangular assembly occupying a portion of the base member. Stationary treads 20 and 22 are respectively positioned fore and aft of the roller assembly 18.

Upwardly extending from the base member is a frame. The frame is shown to include the four upright posts 24, 26, 28 and 31, respectively positioned in each corner of the base member. Connecting rods are located proximate the upper ends of the posts and form a substantially horizontal rectangular interconnection. The interconnecting rods include the two side rods 30 and 32 and the end rods 34, 36.

As can best be seen in FIG. 2, the interconnecting rod 30 is coupled to the upright post 24 by means of a T connector 38. The T connector has three regions with internal threads mating with the external threads 40 on the connecting rod, and 42 and 44 on the upper and lower sections of the posts 24. The upper section of the post 46 is available for grasping by the user providing an additional means of holding onto the exercise device as can best be seen in FIG. 2.

In order to facilitate grasping of the various parts of the post and interconnecting rods, an external covering, such as a rubber insulation 48, is positioned over each of the upright extensions of the post forming the upper section 46. Similarly each of the interconnecting rods 30, 32, 34, and 36 are each covered with the insulating covering.

The front and rear connecting rods 34, 36 are spacedly interconnected between the side connecting rods 30 and 32. Specifically, one end of each connecting rod 34, 36 has an eye 50 connected thereto and extending around the side connecting rod to which it is attached to thereby permit pivoting of the front and rear connecting rods about the side connecting rods to which it is attached. The other end of the connecting rod extends across to the opposite side connecting rod and is hooked onto it by means of a hook arrangement as can best be seen in FIG. 4.

The hook 52 is secured into the connecting rod 34 and can hook onto the side connecting rod 30. As can best be seen in FIG. 2, a break or gap 54 is placed in the insulation 48 covering the side rod 30 in order to permit the hook to directly grasp onto the side connecting rod. At the same time a similar break or gap would be formed at the opposite end where the eye is located around the side connecting rod.

With reference now to FIGS. 3 and 4, it will be noted how the front and rear connecting rods can be locked into place on their respective side connecting rods.

The insulating covering 48 over the front connecting rod 34 can be moved to the left to tightly clasp the hook onto the side connecting rod 30 thereby holding it in place. In order to open the connecting rods the insulating material 48 can be moved to the right thereby exposing the hook 52 and permitting its removal from the connecting rod 30.

The upright frame permits the user to enter into the exercising area on top of the base member through either the front or rear by unhooking either the front connecting rod 34 or the rear connecting rod 36. The rod is then returned to its place and the user is positioned within the area defined by the base members. The user can then jog or walk as will hereinafter be described. He can hold onto the front or rear connecting rod or if he is tall, he can hold onto the upright extension of the upper sections. He can also grasp other portions of the frame as will be comfortable and convenient for him during his exercising.

A specific feature of the invention is that he either can enter from the front or the rear and he can face in either direction, specifically in front or rear, since in either direction there are provided holding bars on which he can grasp. He can furthermore exit from either the front or the rear without necessitating turnaround in order to leave from a particular direction.

Referring again to FIG. 1 there will be noted that the base member is supported at one end by the support leg 56 downwardly depending from the base member. A rubberized surface 58 can be placed on the bottom of the support leg to prevent its slipping from the support surface.

At the opposite end of the base member there is provided a level adjusting device shown generally at 60 and which will be explained in connection with FIG. 5.

At each front corner of the base member 12 there are placed steel plates 62, 64 which included aligned threaded holes and through which pass the threaded post 66. A bottom foot 68 of insulating material and an upper stop 70 of similar material are placed on the threaded post 66. Adjacent to the threaded post is one of the upright posts 24 forming part of the frame. On the post 24 are included a series of calibration lines 72 to judge the height of the threaded posts 66.

By rotating the post 66 in the steel plates, the front end of the base member can be lowered with respect to the rear end thereby providing a simulated uphill resistance. By turning around and facing the elevated rear end, the individual will simulate a downhill resistance.

A particular feature of the present invention is the combination of the upright frame with the level adjusting means to permit unique exercising on the apparatus. Specifically, the apparatus can be adjusted so that the base member provides an uphill incline. The jogger can then face in the direction toward the end of the base which has the level adjusting means and can attain a simulated uphill stride.

However, it has been found, that in jogging on a straight surface or an uphill incline, specific muscles in the legs and arms are utilized. When jogging downhill different muscles are exercised. By using the present combination of the frame and the level adjusting means after the user has jogged or walked in the uphill direction he can turn about and face the end of the base having the support leg 56 and he can now attain a downhill stride. He can now continue his walking or jogging in a downhill manner thereby providing the necessary exercise for all the muscles involved. When facing the end of the base having the support leg 56, the feet move easier since the feet move backward with little effort.

Referring to FIG. 5 it will be noted that the post 24 can be easily connected and disconnected from the base member to disassemble the exercising apparatus. Specifically, located adjacent all corners of the base member 12 are threaded studs 74 screwed into the base member 12 and retained in place by means of the lock nut 76. The lower end of the post 24 has an outwardly turned flange 77. A floating nut 78 is located on the lower end of the post 24 and includes inwardly turned lips 80 which are retained by the flange 77. The floating nut 78 can thread onto the threaded stud 74 to provide a tight attachment of the post onto the base member. At the same time, it permits easy assembling and disassembling of the frame without any tools. It should be noted that the posts of the frame are formed of hollow tubing. As a result, a pilot stud 82 upwardly extending from the threaded stud 74 and having a thinner diameter can be provided for matingly engaging the hollow tubing thereby providing a locating means for positioning the posts in their proper place. The posts are hand tightened and by fastening of the hooking connecting rods, loosening of the floating nut is prevented.

Referring now to FIG. 6 there is shown details of the roller assembly construction 18. Specifically, the roller assembly includes a plurality of axles 84 which are supported by the support bars 88 placed perpendicular to the axles 84. Aligned bores 86 are formed through the supporting bars to receive the axles therein.

Between each adjacent two support bars 88 are located a pair of rollers 90, 92, spaced apart from each other by a small distance and similarly spaced apart from the adjacent walls of the support bars also by a small distance. The rollers are positioned on the axle to permit their rotation around the axle. The rollers are formed of shock absorbing material, as for example rubber.

Figure 7A:
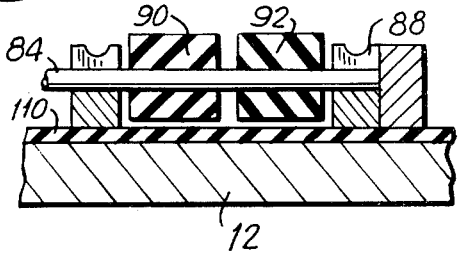
FIGS. 7A and 7B respectively show fragmentary sectional views taken along line 7A—7A and 7B—7B, respectively of FIG. 6.
Figure 7B:
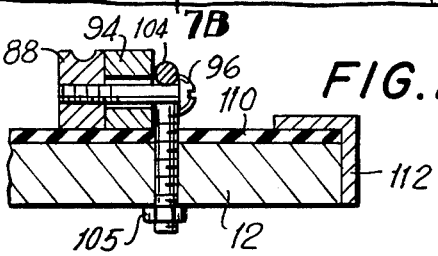

Retaining bars 94 are located on the outside of the outermost support bars 86 and are securedly connected onto the outermost support bars by means of the fastening screws 96 which pass through the retaining bars and are securely fastened into the support bars adjacent thereto, as can be seen in FIG. 7B. A series of tie rods 98 extend completely through drilled holes in the support bars and extending across the roller assembly from one edge to the other. The tie rods are pinned or welded 100 to each support bar allowing the desired spacing between these bars. This allows for a permanently fixed frame and keeps the spacing between the support bars at the desired amount.

Figure 10:
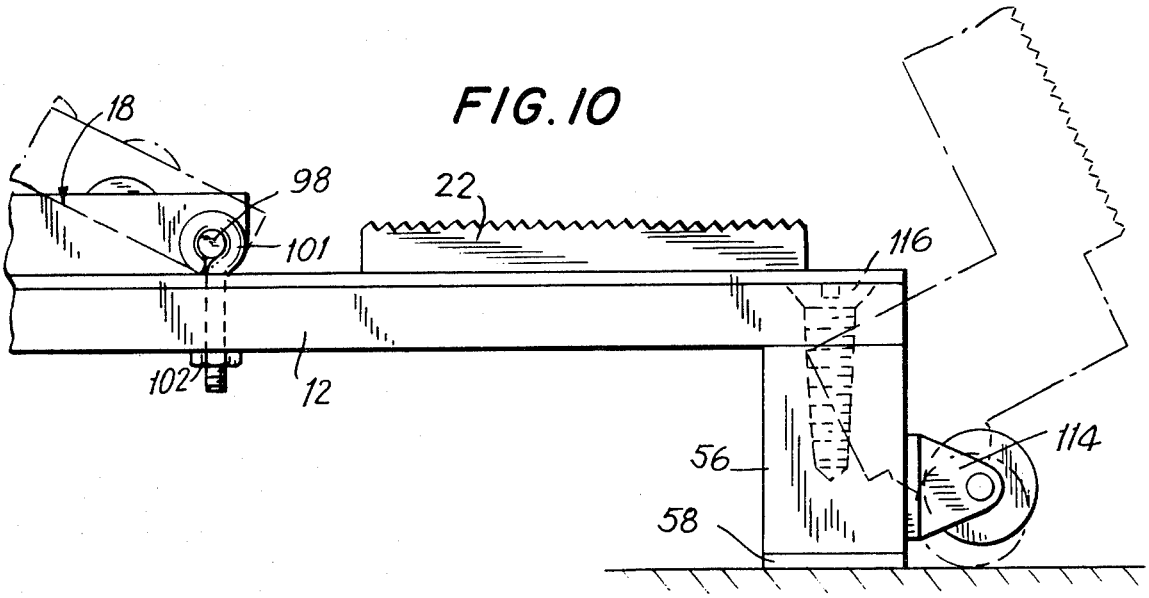
FIG. 10 shows a fragmentary side view of the rear portion of the base member and showing the portability and transporting features of the invention.

The roller assembly is pivotally hinged to the base member to permit cleaning beneath the roller assembly. As can be seen in FIG. 10, the rearmost tie rod 98 has placed thereon a series of eye bolts 101 which extend through the base member 12 and are securely retained by means of the lock nuts 102. The tie rod 98 can thereby pivot through the eyes of the eye bolts. In order to retain the front end in place, a number of additional eye bolts 104 are interconnected against the outer retaining bars by means of the fastening screw 96. The eye bolts are threaded through the base member 12 and are held by lock nuts 105.

Figure 9:
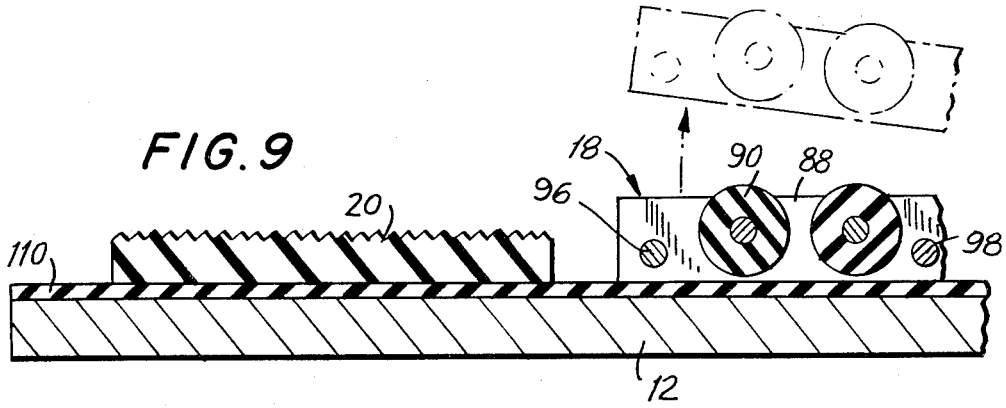
FIG. 9 shows a fragmentary sectional view of a portion of the base member showing the stationary tread and the pivoting of the roller assembly from the base member.

In order to hingedly lift the roller assembly, screws 96 are unscrewed thereby releasing the roller assembly from the eye bolts 104. The roller assembly can then be pivoted upwardly by pulling up on the front end of the roller assembly as can best be seen in FIG. 9.

With reference now to FIG. 8, it will be noted that each bar of the support bars 88 has a channel 106 formed across the top surface of the bar. Transverse lubricating slots 108 extend downwardly from the top surface to the bore 86 which receives the axles 84. By placing a film of lubricating oil along the channel 106, the oil will move along the channel and reach each of the lubricating slots. The oil will flow down the slots onto the bore and from there onto the axle. It will move along the axle thereby lubricating the inside diameter of the rollers permitting them to freely move on the axles.

It should be noted that this simple method of lubrication permits usage of the device immediately thereafter since the roller surfaces are well above the lubricating channels of each support bar. It should also be noted that this lubricating procedure takes only a few minutes and on application of a film of oil in the channels of the supporting bars restores satisfactory performance of the device for two weeks or more.

It should be noted from the figures that the top surface of the base member includes an insulating layer 110 formed as a resilient pad over the entire surface of the base member. Also, the side edge of the base member includes an L-shaped metal edging 112 to provide additional support for the device. A caster 114 is placed against the outer edge of the support leg 56. In this manner, the base member can be upwardly pivoted, as shown in FIG. 10, and transported by rolling along the casters 114 for movement to another location or for storage. The support legs themselves are held firmly onto the base member by means of the fastening screws such as the one shown at 116.

It should be appreciated that the entire jogging apparatus can be easily disassembled and stored. Specifically, the upright posts of the frame can be disconnected from the base member by means of releasing the floating nuts at their lowermost edge. Then, by releasing the hook holding the connecting rods, the connecting rods will pivot downward, whereby the frame will be formed into two substantially flat side sections. These sections can be stored in a small area. The base member can then be picked up and wheeled to a proper storage location. The compact assembly also permits shipping of the jogging apparatus in a flat container occupying minimum space.

When utilizing the exercising device, the user enters the exercising area and begins moving his feet along the rollers on the roller assembly. The rollers beneath each foot will move as the foot passes over the rollers. Accordingly, only those rollers that are in contact with the moving foot will move. Thus, effectively, there are provided separate treads for each foot. As a result, a user can utilize the exercising apparatus not only for jogging but even for walking at whatever pace he desires.

With prior art devices there is typically provided an endless belt which forms a unitary jogging surface on which both feet move. As one foot moves along the jogging surface and pushes the endless belt, the entire belt moves whereby the portion under the other foot will also be moving. It is therefore necessary to have only one foot on the jogging surface at a time. This necessitates a jogging movement since during a walking movement both feet may be touching the surface during a portion of the time.

With the present roller assembly, it is possible to have walking as well as jogging. This is a special benefit for many individuals. For example, individuals first starting on the exercising device will begin with a walking warmup period followed by the jogging and concluding by again a slow walking. Additionally, many individuals cannot carry out the fast pace of jogging because of their age or surgical inability. Walking at a brisk pace, especially uphill, or even downhill provides them with sufficient exercise.

By having the rollers closely spaced to each other, the foot will effectively feel a substantially flat surface and will not be effected by the individual rollers. Furthermore, because the jogging or walking surface does not include an endless belt, there is very little vibration of the device and it remains extremely rigid and sturdy during use.

By utilizing the present exercising device, one can achieve both walking or jogging and can provide both an uphill and a downhill stride. The device allows the user complete control of the amount of effort or stress he desires without necessitating the readjustment of the device. The device also permits both backward and forward movement of the feet without raising them. This may provide good therapy for those needing initial mild movement of the extremities. Furthermore, while holding onto the uprights, the arms and shoulders as well as the chest can also be exercised by pulling the whole body back and forth the full length of the base while having both feet together. The construction of the device is such that it is durable, simple, convenient, easy to assemble and store. Furthermore, it permits easy fabrication and assembly, low labor costs, compact packaging, and simplified maintanence.

A specific embodiment of the invention has been formed with a base member 36 inches by 19 inches formed of $\frac{1}{4}$ inch birch veneer plywood. Its entire top was covered with a $\frac{1}{8}$th inch grooved rubber matting. The sides of the base were trimmed with $\frac{3}{4}$ inch angled chrome. The frame was formed of $\frac{1}{2}$ inch standard threaded pipe and fitting. The top and side posts and connecting rods were made 32 inches long. The eye bolts and hooks used to interconnect the connecting rods to the frame were 5/16th inch eye bolts and 5/16th inch clasping hooks. The bottoms of the post contain the female half of a half union which fastens to the male half on the base.

The roller assembly included thirty $\frac{1}{4}$ inch polished steel rods for the axles each being $12\frac{3}{4}$ inches in length. The support bars included ten steel bars 3/16th inch by $\frac{3}{4}$ inch by 24 inches. A 1/32nd inch groove was ground to run across the top of the supporting bars and included slots which reach down to the $\frac{1}{4}$ inch drilled holes. Each of the rollers was formed of 2 ply rubber having a smooth or corrugated surface with a $\frac{5}{8}$th inch outside diameter and and inside diameter of about 0.253 inches. Each roller was 9/16th inch in length with $1\frac{1}{4}$ inch spacing provided between adjacent support bars. The retaining bars were steel bars 3/16th inch by $\frac{3}{4}$ inch by 24 inch. They were drilled with $\frac{1}{4}$ inch holes which matched additional $\frac{1}{4}$ inch tapped holes in the support bars in order to receive the fastening screws.

The base member included five eye bolts screwed into $\frac{1}{4}$ inch holes in the base through which pass one of five $\frac{1}{4}$ inch steel rods used as the tie rods. The ends of each of the tie rods were pinned or spot welded to the support bars. The eye bolts were all secured by means of washers and lock nuts under the base member. Some of the eye bolts were utilized with the $\frac{1}{4}$ inch fastening screws to retain the front end of the roller assembly to the base. $\frac{1}{4}$ inch steel plates were riveted together at the front edge of the base and provided with $\frac{1}{2}$ inch tapped holes receiving $\frac{1}{2}$ inch threaded rods for the incline adjustment. Heavy no skid rubber mats were used at the front and rear for the stationary treads.

The apparatus has a fixed elevation of about 4 inches at one end of the base and an adjustable lowering device at the other end of the base which is calibrated to permit an incline with a range from a flat level to about 2 inches below that of the elevated base end.

During usage, when facing the fixed elevated base end there is provided a variable degree of reduced resistance simulating the action of walking or jogging downhill. When facing the adjustable base end having the lowering device, the incline provides a variable degree of increased resistance simulating the action of walking or jogging uphill.

In using the apparatus, prior to entering into the apparatus, an incline adjustment can be made to suit the individual needs. The user then steps on the device, and facing the elevated base end, the user can start with a reduced resistance warmup thereby simulating walking or jogging downhill. After the warmup period, increased resistance can be achieved by simply aboutfacing towards the direction of the adjustable lower end and simulating an action of walking or jogging uphill. After completion of the strenuous second phase of the excercises, the user can again about face and now return facing into the direction of the fixed elevated end. He can now begin unwinding from the strenuous exercise by walking or jogging with the reduced resistance as in the beginning phase. Thus, the device provides an apparatus for a complete workout without having to interrupt or step off the device for additional adjustments.

In summary, the present invention provides various combinations of usefulness which are not found in the prior art treadmill device. The shock absorbing rollers allow bidirectional action with reduced vibration. The variable adjustable incline, the readily removable uprights and the mobility of the device for storage also adds to its usefulness. The multiple support means for holding on during the exercise is another improvement and feature of the invention. The present invention is able to be used with all of the various above features and combinations to make it a convenient, versatile, home exercising device for walking or jogging.

There has been disclosed heretofore the best embodiments of the invention presently contemplated. However, it is to be understood that various changes and modifications may be made thereto without departing from the spirit of the invention.

I claim:

1. An exercising apparatus, comprising:

a base member; a roller assembly positioned on said base member and comprising an array of discrete rollers, and a frame upwardly extending from said base member and defining an enclosed exercising area; said roller assembly comprising a series of parallel axles, a plurality of closely spaced rollers mounted on said axles for individual rotation thereon, and support means for supporting said axles; said support means comprising a series of elongated support bars spacedly positioned from each other and being in perpendicular relationship with said axles, aligned bores formed in said support bars for rotatingly receiving said axles therethrough, said rollers being located along the sections of said axles between the support bars, such that there are a pair of closely spaced rollers located on each axle between adjacent support bars with the support bars being closely spaced to the rollers, and further comprising a longitudinal channel formed along the top of each support bar, a vertical opening downwardly extending from the top of each bar to the respective bores in that bar, whereby lubricating oil placed into the channel of a bar can flow therefrom to each bore in the bar and then along the axles to thereby lubricate the roller assembly.

2. An apparatus as in claim 1 and further comprising elongated retaining bars fastened to the laterally outermost support bars, and tie rods interconnecting said support bars.

3. An apparatus as in claim 2, wherein said roller assembly forms a rectangular array, one of said tie rods being located adjacent one end of said array, hinge means connecting said one of said tie rods to said base member, and removable coupling means for holding the other end of the assembly to the base member.

4. An apparatus as in claim 1, and further comprising hinge means for hingedly connecting said roller assembly to said base member.

5. An apparatus as in claim 1, and further comprising level adjustment means coupled to said base member for angularly adjusting the incline of said base member relative to a support surface.

6. An apparatus as in claim 5 and further comprising calibration means associated with said level adjustment means for determining the incline of said base member.

7. An apparatus as in claim 1 and further comprising stationary treads located on said base member fore and aft of said roller assembly.

8. An apparatus as in claim 1 and further comprising a support leg extending from at least one edge of said base member, and caster means outwardly extending from said support leg, whereby said base member can be upwardly pivoted from a support surface and wheeled on said caster means.

9. Apparatus as in claim 1, wherein said discrete rollers are individually rotatable, whereby a user walking on the roller assembly can have each foot independently operate a corresponding part of the roller assembly.

10. Apparatus as in claim 1, wherein said frame is removably coupled to said base member.

11. An apparatus as in claim 1, wherein said base member is substantially rectangular in shape, and wherein said frame comprises four upright posts positioned proximate each corner of the base member, and four horizontal rods peripherally interconnecting said upright posts proximate their upper ends.

12. An apparatus as in claim 11, wherein at least one of said interconnecting rods is detachably coupled to the other of the rods to permit entry into the exercising area.

13. An apparatus as in claim 12 and further comprising lock means for locking said detachable rods to other of the rods when in a closed position.

14. An apparatus as in claim 12, wherein two of said interconnecting rods are detachably connected to one side of the frame and pivotally connected to the other side of the frame, and wherein said uprights are detachably coupled to said base member, whereby when detached, said frame forms two side sections.

15. An apparatus as in claim 14 and further comprising four threaded studs upwardly extending from proximate the respective four corners of the base member, the lower end of each of said posts having an outwardly extending flange and further comprising a floating nut retained by said flange and adapted to lock onto said threaded studs.

16. An apparatus as in claim 15, wherein said posts are formed of tubular material, and further comprising a pilot stud upwardly extending from said threaded stud for matingly engaging the tubular post.

* * * * *